US008407824B2

(12) United States Patent
Springer

(10) Patent No.: US 8,407,824 B2
(45) Date of Patent: Apr. 2, 2013

(54) MULTIPLE POSITION UNDERWATER BIRTHING STOOL

(76) Inventor: Kara Ayanna Springer, Toronto (CA)

( * ) Notice: Subject to any disclaimer, the term of this patent is extended or adjusted under 35 U.S.C. 154(b) by 0 days.

(21) Appl. No.: 13/052,045

(22) Filed: Mar. 18, 2011

(65) Prior Publication Data

US 2011/0283454 A1 Nov. 24, 2011

Related U.S. Application Data

(60) Provisional application No. 61/315,019, filed on Mar. 18, 2010.

(51) Int. Cl.
*A47K 3/022* (2006.01)

(52) U.S. Cl. ..... 4/579; 4/578.1; 4/571.1

(58) Field of Classification Search ..... 5/600, 602; 4/571.1, 578.1, 579
See application file for complete search history.

(56) References Cited

U.S. PATENT DOCUMENTS 2,985,889 A * 5/1961 Fain et al. ..... 4/575.1
4,521,926 A * 6/1985 Kuether ..... 4/579

* cited by examiner

*Primary Examiner* — Fredrick Conley

(57) ABSTRACT

A birthing stool is disclosed comprising a series of closed walls constructed from a non porous rigid material, molded into compound curves. The stool facilitates a range of physiologically effective positioning for labor and delivery and can be used submerged underwater during waterbirth. The stool ergonomically supports the body while also achieving structural integrity through a simple organic form that can be produced inexpensively using minimal material. All elements of the stool, including a seat portion that accommodates a laboring woman and her birthing partner, as well as handles and grips for carrying are integrated into a single part design, facilitating effective cleansing and disinfection of the apparatus.

The invention includes the method of production of the stool, and describes method of using device.

9 Claims, 4 Drawing Sheets

MULTIPLE POSITION UNDERWATER BIRTHING STOOL

TECHNICAL FIELD

The invention relates to a birthing apparatus, and more particularly to obstetric chairs or stools.

BACKGROUND ART

Historically birthing stools have been designed to allow mothers to be in a sitting rather than the standard laying position during birth. This is a more natural and physiologically effective position allowing the mother to push more efficiently thereby reducing the stresses of birth on the mother and infant. In a prior art type of this class of birthing stool, a squatted or seated position is supported by a u-shaped seat at a horizontal angle (parallel to the ground). Another prior art example utilizes an angled u-shaped seat with no two-dimensional or three-dimensional curves (i.e. Birth Works birthing stool produced in South Africa). These prior art examples have the disadvantages of a flat sitting surface which does not accommodate the natural anatomy of the female pelvis. Pressure is therefore not evenly distributed over the gluteal area leading to pressure points and the normal lumbar lordosis (curvature) is not accommodated. This can lead to pain over the ischial tuberosities and lower back.

The World Health Organization encourages the practice of freedom in position and movement throughout labour since use of the upright position among other non-supine positions results in a healthier and less painful delivery. Prior art of this class of birthing stool allow for a single position, squatting or seated, depending on the height of the stool (i.e. Birth Mate birthing stool produced in the Netherlands).

Prior art apparatus consist of a u-shaped seat mounted on three or four legs, or that is attached to the ground by side walls whose bottom side sits flush with the floor along a linear path of contact, generally in a semi-circular form. These disparate and perpendicular points of contact with the ground cause a lack of structural integrity and stability in response to forces contacting the stool at varying angles, instead assuming a standard vertical pressure relatively straight downwards. Thus existing birthing stools are not stable enough to be used as a support for positions in which the laboring mother is leaning on the stool for support either in a kneeling position, or standing with one leg on the stool in a lunging position, both of which carry benefits during the second stage of labor and delivery for some. Kneeling is an ideal position in the first stage of labour, helping with the strength, frequency and regularity of contractions, which can aid in the successful dilation of the cervix. Kneeling, or standing with one foot raised in a lunging position (also called the stork position for birthing) with the upper body leaning forward also helps the progression of labour during the second stage. Many women also find that kneeling reduces pain during delivery.

Currently in some hospitals, regulations do not allow for delivery outside of the hospital bed. The instability of prior art apparatus does not allow for existing birthing stools to be used on a bed, which is at times desirable, allowing the facilitation of more effective birthing positioning while adhering to standard hospital regulations.

Due to individual differences in height, as well as individual preferences for the angle of the legs, pelvis, and back in a seated or squatting position during labor and delivery, no single height can be ideal for all, or even most, expectant mothers. No prior art apparatus facilitate a seated or squatted position at varying heights.

Many prior art examples are made of wood which do not allow for adequate cleansing and disinfection of the bodily fluids involved in childbirth. One prior art example is made of fiberglass which allows for cleansing and disinfection, however mechanically attached handles create crevices into which bodily fluids can become trapped (Birth Rite birthing stool produced in Australia). Another prior art example is made of plastic which can be disinfected, but does not have any handles or grips.

Exposure to water during labour is a natural and effective method of easing pain for many laboring women. Water births, in which women give birth in a birthing pool or tub are thus becoming an increasingly common practice. The prior art apparatus made of wood cannot be used with water without being subject to warping of the material. Other prior art apparatus made of plastic, fiberglass, and metal, can be used in a shower, but do not allow for submersion underwater for use in a birthing pool or tub. Further to the above regarding disinfection and water submersion, the ability to adequately completely disinfect the device, including all surfaces, not only those in contact with the user's body, becomes exceedingly important in the case of full submersion of the device into the warm water used in a birthing tub or pool. In these circumstances any trace of bodily fluids on the apparatus could contaminate the water, thus coming into intimate contact with the laboring mother and creating the risk of infection.

One prior art stool was exhibited by this inventor in 2005, which demonstrated a stool comprised of compound curves, with a double ridge design, allowing for optimal support of the birthing mother on one ridge, and a second ridge allowing for a second individual to be seated behind the mother during labour and delivery. This prior art model was hand-carved and then finished by hand with the use of fiberglass. This labour intensive method of production did not allow for economic production of the stool. The design was further disadvantaged by organically shaped hollow walls 1-2" thick, with the top and the bottom of the stool being attached by three organically sloping walls, each approximately equidistant from the next. The spaces between the walls and the entire interior of the stool were thus open and exposed. This complex pattern of thick and hollow walls meant that the stool was buoyant, and any effort to sink the stool by filling the walls with water would mean that the interior of the walls would be inaccessible, and thus impossible to clean and disinfect. Further the volume of water able to be accommodated in the hollowed walls would not be adequate to counteract the buoyancy of the material, meaning that submersion of the stool underwater was not possible by this means.

SUMMARY OF INVENTION

Objects and Advantages

Accordingly, it is an object of the invention to provide a novel device for labor and delivery.

It is a further object of the invention to provide a device that allows for the support of a range of physiologically effective positioning during labor and delivery, including squatting, seated, kneeling, and lunging in a standing position.

Further object of the invention will be to likewise accommodate the full range of aforementioned positioning while submerged underwater in a birthing tub or pool.

A rigid non-porous material is required for adequate cleansing and disinfection, and to provide support in response to active pushing and gripping during labour. In order to meet this requirement, and to meet the ergonomic needs of the body, the shape and relationship between the compound curves of the top, and side and back walls of the stool, allow for a certain amount of flexibility in the walls of the stool, facilitating a slight give in response to the weight of the body, making the stool more comfortable and ergonomic.

It is still further object of the invention to utilize manufacturing technology that allows for a series of compound curves that offer maximal support to the ischial tuberosities in a supported squat, leaving the birth canal open and unobstructed, and thus easing passage of the child during childbirth. The use of compound curves will also be advantageous in integrating handles into a single part stool design, significantly reducing the risk of infection due to contamination of water by trapped bodily fluids during water births.

It is still further object of the invention to be stable enough to allow for it to be used on top of any platform surface, including the floor or bed, or a specially designed platform intended to adjust the height of the stool in order to accommodate the different ergonomic needs of individual women, as well as for use in a hospital bed.

It is still further object of the invention that the arrangement of compound curves allow for the use of the stool in a number of orientations extending the range of positioning as well as the range of motion supported by the device.

It is still further object of the invention to provide a stool with an unobstructed interior which is fully accessible for adequate cleansing and disinfection before and after use for childbirth while submerged in water.

Further object of the invention is to support both a birthing mother and her partner for emotional and physical support during labor and delivery.

In accordance with the above and further objects of the invention, a stool consisting of a series of compound curves, and a flat bottom surface, will provide support for a range of physiologically effective positioning during labor and delivery, including but not limited to a supported squatting position, seated, kneeling, standing lunging, as well as submerged for water birth.

A rigid non-porous material is required for adequate cleansing and disinfection, and to provide support in response to active pushing and gripping during labour. In order to meet this requirement, and to meet the ergonomic needs of the body, the shape and relationship between the compound curves of the top, and side and back walls of the stool should allow for a certain amount of flexibility in the walls of the stool, facilitating a slight give in response to the weight of the body, making the stool more comfortable and ergonomic.

The device will take the shape of an organically curved object such that it facilitates flexible movement between the range of positions which it supports. The compound curves will be utilized to eliminate any hard edges or corners that would hinder this type of movement.

The nature of the composition of compound curves forming the device allow for it to be used in a range of orientations, for example tilting the stool onto its side, or its front. This allows for the stool to be used as support for a rocking motion when the convexly curved surfaces of the stool are in contact with the ground. In this scenario an expectant mother would be kneeling or squatting on the ground while leaning her upper body on the stool, with both her body and the stool moving in a gentle rocking motion.

It is further object that the device can be easily submerged in a body of water, thereby accommodating the benefits of water births.

The nature of the cavity created in the interior of the stool must be such that the volume of water that fills the stool is great enough to overcome the buoyancy of the non porous material of the stool, so that the stool will stay underwater with no need to apply additional force once it has been submerged. Otherwise once downward pressure was relieved, the stool would pop violently upwards so that the entire stool would float above the surface of the water, creating a hazard for a laboring woman moving around in a birthing pool or tub. To this end, the amount of material used to make the stool should be minimized while maintaining the structural integrity of the stool.

Properly manufactured, the stool will be constructed with no mechanical joinings in order to avoid the creation of crevices in which the bodily fluids associated with childbirth might become trapped, thereby creating a danger of contamination and the spread of disease between users. Rather than handles constructed of a separate material, grips or handles are integrated into the curved form of the seat and sides of the stool through the manipulation of the compound curves from which the stool is constructed.

BRIEF DESCRIPTION OF THE DRAWINGS

The form is best understood with reference to the attached figures.

DETAILED DESCRIPTION OF THE DRAWINGS

Figure 1:
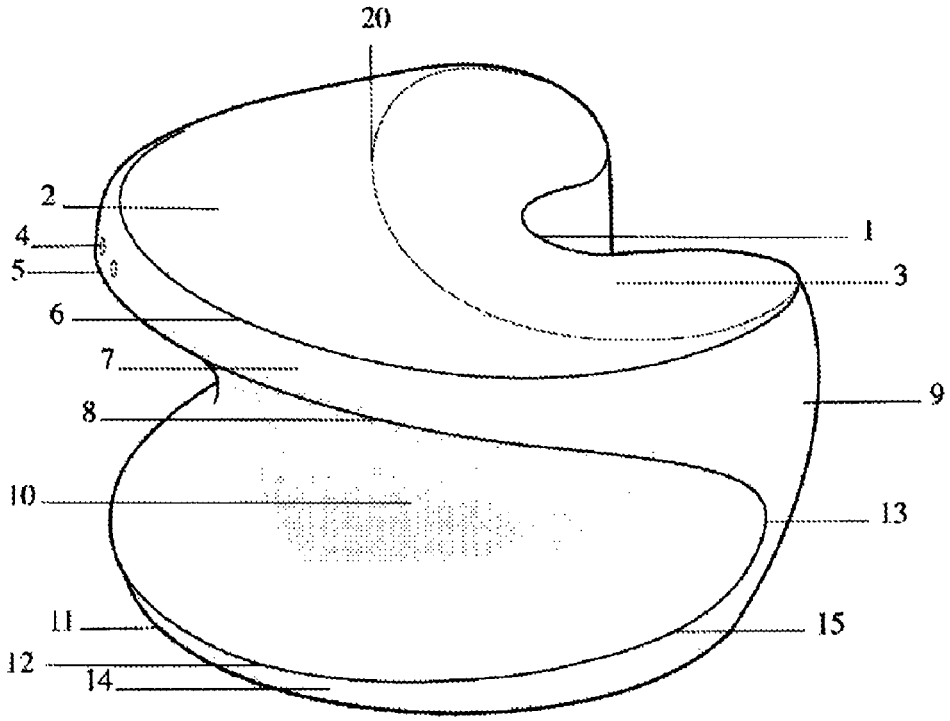
FIG. 1 is a perspective view showing the top and side of the device.
Figure 2:
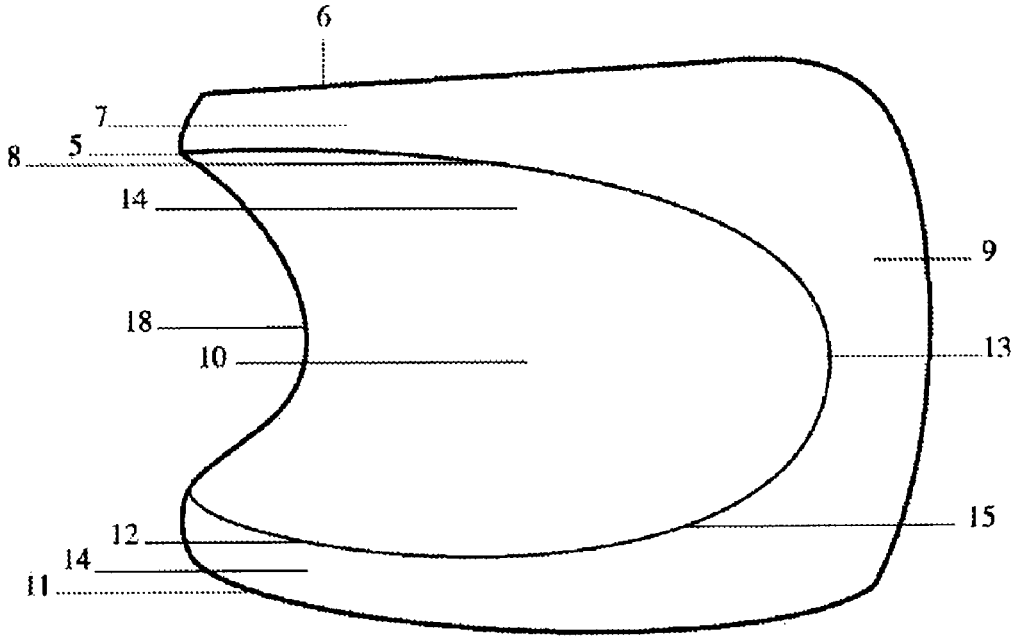
FIG. 2 is a side view of the device.

FIG. 1 shows a birthing stool comprised of a series of compound curves, the seat of which is divided into two ergonomic ridges. The back ridge 2 is ergonomically curved for a comfortable seated position, and the front ridge 3 is curved and angled downwards to provide maximal contact and support of the ischial tuberosities, accommodating a supported squatting position. This support allows for optimal positioning of the pelvis, leaving the birthing canal open and unobstructed for delivery. The front section of the stool has an indented section 1 which facilitates access to the perineum during delivery. The angle of the ridge combined with the indent also serve to relieve pressure on the perineum.

A rigid non-porous material is required for adequate cleansing and disinfection, and to provide support in response to active pushing and gripping during labour. In order to meet this requirement, and to meet the ergonomic needs of the body, the shape and relationship between the compound curves of the top, and side and back walls 2, 10, 18 of the stool, allow for a certain amount of flexibility in the walls of the stool, facilitating a slight give in response to the weight of the body, making the stool more comfortable and ergonomic.

The curve of the upper seat slopes downwards along a radius curve 6 to meet the sides of the stool 7, 9. Along the back and sides of the stool, the slope then changes, angling inwards, towards the center of the stool in order to create a ridge 8 that can act appropriately as handles or grips for an individual seated on the upper surface of the stool, at any point from the back 5 to the front of the sides of the stool 13, with the ridge becoming gradually lower from the back of the stool to the front of the sides 5, 8, 13, and eventually sloping downwards, and then backwards 15, 12 in a looped or circular manner creating an indent or a series of indents across the sides and back of the stool. Whereas the prior art devices allow for gripping in one particular position, this curve 8, 13, allows for a continuous handle from the back to the front of the stool, optimizing the flexibility of positioning and use of the birthing stool. An example of such a slope and indent is shown in FIGS. 1, 2, 3 and 5. This composition of compound curves creates ridges 7, 14, likewise exampled in FIGS. 1, 2, 3 and 5 which aid in lifting and carrying the object.

Figure 3:
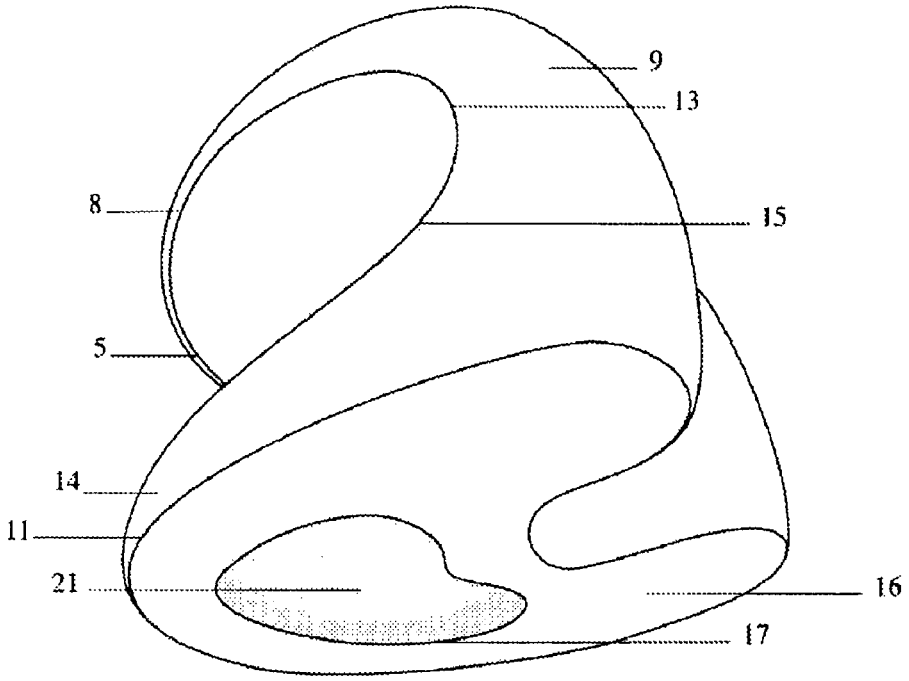
FIG. 3 is a perspective view showing the bottom and side of the device.
Figure 4:
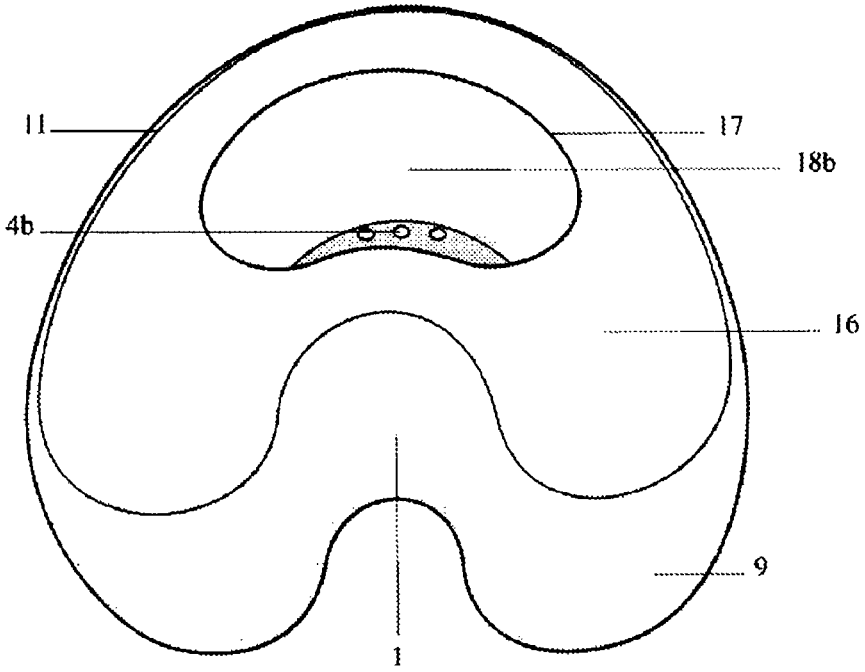
FIG. 4 is a perspective view showing the bottom and interior of the device.
Figure 5:
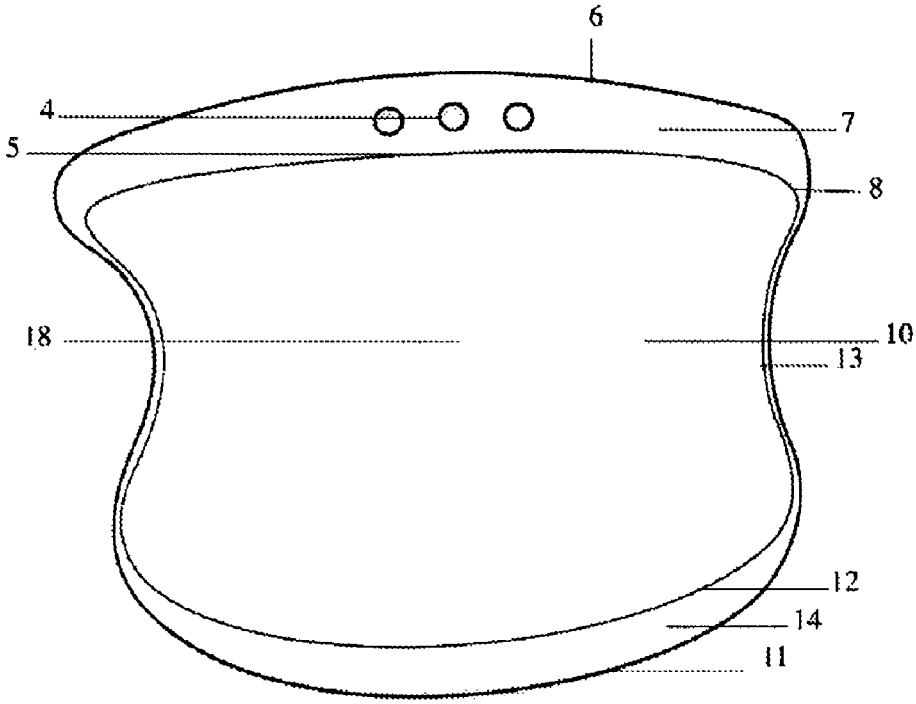
FIG. 5 is a back view of the device.

The arrangement of the curved walls will allow the stool to act as a container capable of filling with water, with a large hole in the bottom 18*b*, and one, or many small holes close to the highest point on the stool 4 in order to allow water and air to flow in and out of the stool upon lowering into, and removal from the pool or tub. An example of the large hole and series of smaller holes in the bottom and side walls of the stool is shown in FIGS. 3-5. This arrangement of holes means that as the stool is lowered into a body of water, the level of water filling the interior of the stool will constantly match the level of the body of water itself, such that no water ever need be significantly displaced. Further, as the stool is lifted out of the body of water, a similar effect allows the lifting of the stool without significant displacement of water, whereby air is able to enter the stool at the same rate at which the water exits, conversely at the same rate at which the stool exits the water. An alternative method of filling the stool with water through the use of a plug for example, would make the stool exceedingly heavy when lifted out of the body of water. Thus the midwife, birthing partner, or expectant mother would be unable to easily and comfortably move the stool in and out of the birthing tub or pool during labor and delivery.

At a location near to the highest point of the device, there will be one or a number of holes penetrating through from the exterior to the interior of the stool. These holes need to be large enough to allow water or air to enter or escape the interior of the stool, without being so large as to compromise the integrity of the surface on which they are located. An example of an appropriate configuration of such a series of holes 4, 4*b* is shown in FIGS. 1, 4 and 5.

The sides of the stool slope inwards along a radius angle to meet the bottom of the stool. Inside of the radius edge 11 surrounding the entire bottom of the stool 16 is the only flat or planar surface on the device (FIG. 3, 4). It has a section that is cut away providing access to the interior of the stool 17 (FIG. 4). The cut-away portion is large enough to allow one to reach easily into the interior of the stool 21 for the purpose of cleaning by hand without being so large as to compromise the integrity of the strength of the compound curve between the bottom and sides of the stool 11.

Figure 6:
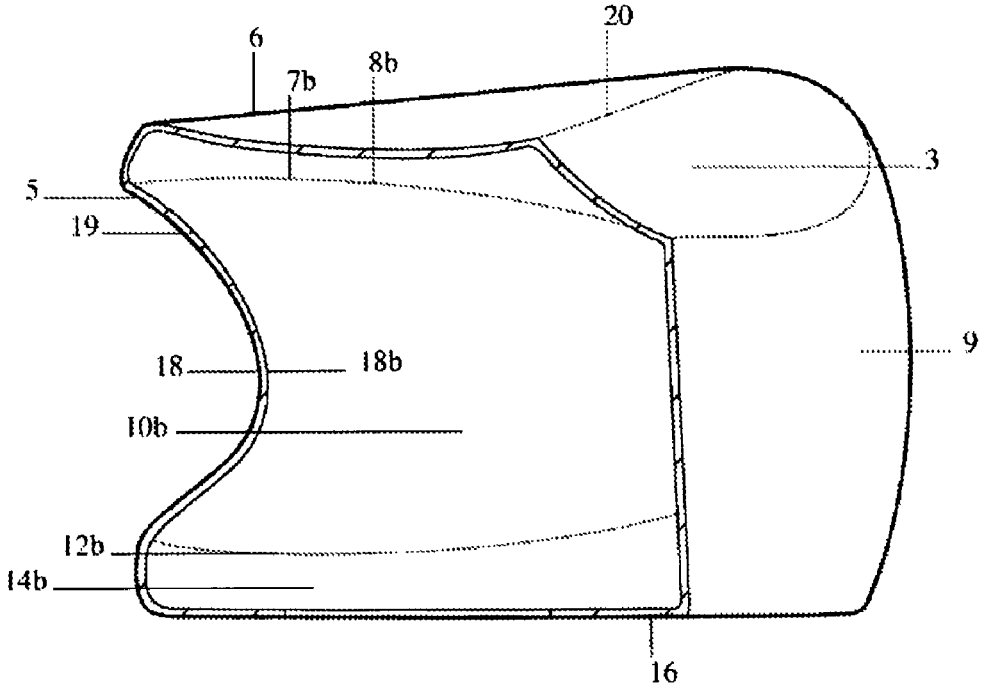
FIG. 6 is a cross section from a side view of the device.
Figure 7:
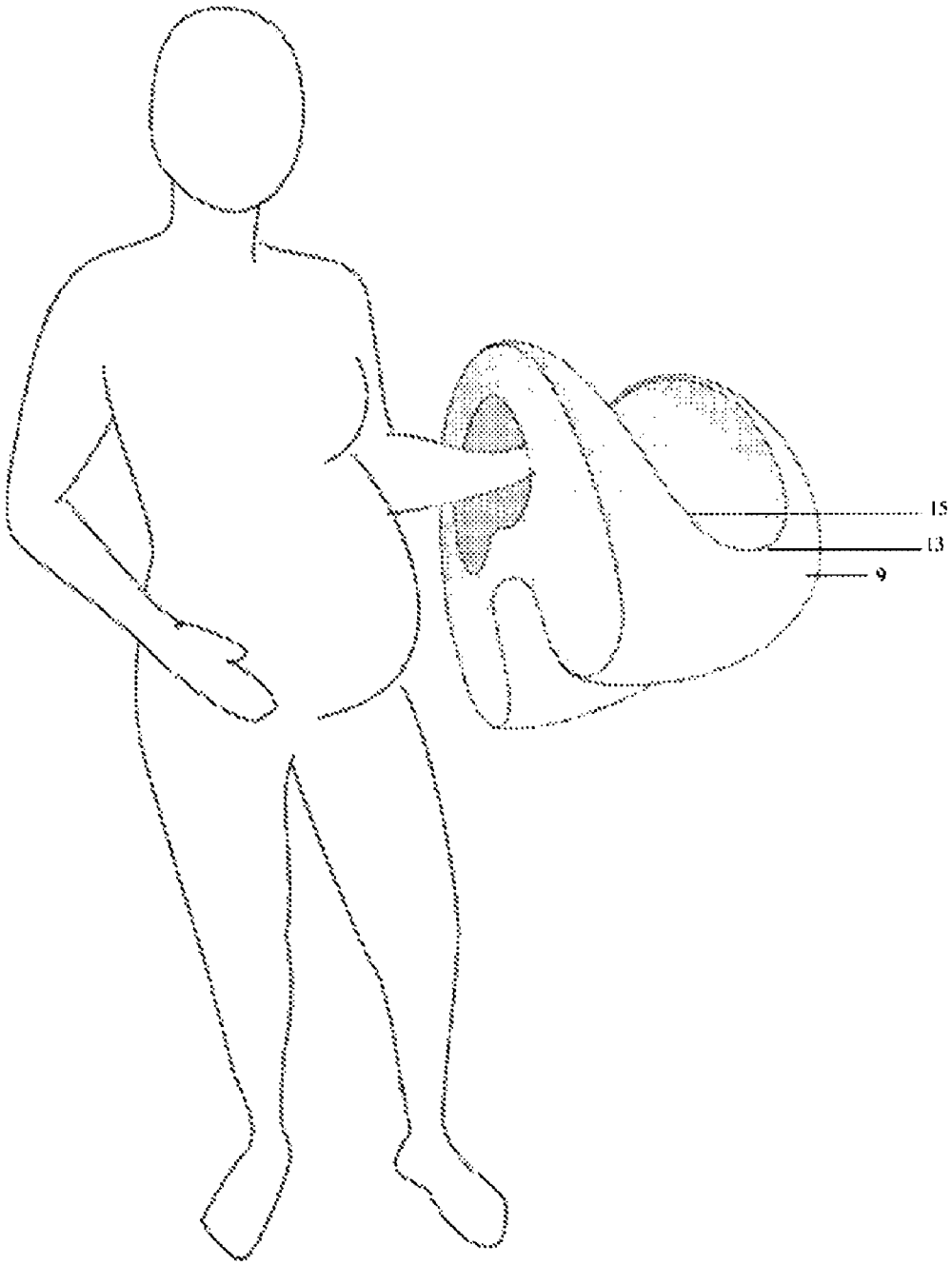
FIG. 7 depicts the device being carried from an opening in the bottom.

Properly manufactured, the stool will be constructed to consist of a single wall of molded plastic or other suitable material, traveling through a series of compound curves, each of which contributes to the strength of the form of the stool. FIG. 6 shows a cross section in which the interior of the stool is visible 7*b*, 8*b*, 10*b*, 12*b*, 14*b*, 18*b*, and the nature of the single exterior wall 19 of the form is represented. The structural integrity created by the series of compound curves 1, 2, 3, 5, 6, 7, 8, 9, 10, 11, 12, 13, 14, 15 is integral in meeting the requirement that the stool support two adult users, one of whom is a pregnant woman.

The inherent structural integrity of the compound curves allows for a minimal use of materials in the simple single wall exterior, facilitating an increased ratio between the volume of water filling the hollow cavity 21, 10*b*, 18*b* and the non porous buoyant material such that the stool is able to remain submerged underwater. The minimal use of materials also serves to 1) decrease cost of production, 2) make the apparatus lighter and easier to carry, and 3) decrease buoyancy of apparatus.

The series of curved walls (top, side, bottom), are arranged such that intersection of walls (top to side, side to bottom, side to back curve, etc) occur at near to or greater than an interior angle of 90 degrees and are joined by a radius curve, or curved fillet on the interior 27, 28, 29, 30, 31, 32, 33, and are rounded on the exterior 6, 11, 20, 22, 23, 24, 25, 26. This manner of joining walls 1) eliminates corners or tight angles in interior cavity which would pose greater difficulty to cleaning and disinfecting the stool, 2) increases durability and ability to load bear, 3) eliminates sharp edges on the exterior which would cause discomfort during usage, and would be more susceptible to damage during storage and use.

The flat planar bottom 16, whose edge is connected by a compound radius curve to the sides of the stool 14, will allow for the stool to sit on the ground or any other flat surface with great stability. This is essential in order to allow for certain positions in which the laboring mother is exerting pressure at varying angles on the stool, such as leaning on the stool with one foot in a lunging position, or kneeling, bent over the stool for support. Further this allows for the stool to be used in a hospital bed, where regulations sometimes do not allow for childbirth outside of the bed.

The terms and expressions which have been employed here are used as terms of description and not as limitations, and there is no intention in the use of such terms and expressions of excluding equivalents of the features shown and described, or portions thereof, it being recognized that various modifications are possible within the scope of the invention claimed.

I claim:

1. A birthing stool comprising: a continuous molded body defining a hollow interior cavity, the continuous molded body including: a top wall; a planar bottom wall;

a side wall interconnecting the top and bottom walls, wherein the side wall includes opposing front and back areas, the back area having a contoured portion that slopes inward with respect to upper and lower back portions of the side wall such that an outer periphery of the upper portion and an outer periphery of a lower portion of the side wall extend beyond the contoured portion.

2. The birthing stool of claim 1, wherein the front area of the side wall further includes a substantially u-shaped contoured portion that slopes inward with respect to opposing lobe portions of the side wall, and wherein the u-shaped contoured portion enables access to a perineum of a user.

3. The birthing stool of claim 1, wherein the top wall comprises a back ridge portion and a sloped front ridge that extends at an angle from the back ridge portion downward toward the side wall, and wherein the back ridge portion enables a user to sit on the top wall in a seated position and the sloped front ridge is configured to support a user in a squatting position with a birthing partner being supported in a seated position on the back ridge portion.

4. The birthing stool of claim 1, further comprising: a handle defined by the upper front portion of the side wall.

5. The birthing stool of claim 4, wherein the handle is a continuous handle extending from the back area to the front area of the stool.

6. The birthing stool of claim 5, further comprising: an opening formed in the body and enabling water to enter the hollow interior cavity of the birthing stool; and an aperture formed in the body and enabling air to exit the hollow interior cavity of the birthing stool.

7. The birthing stool of claim 6, wherein the opening is formed in the planar bottom wall, and the aperture is formed in an upper portion of the body.

8. The birthing stool of claim 1, wherein intersections of the top wall, planar bottom wall and side wall comprise radius curves.

9. The birthing stool of claim 1, wherein the top wall and side wall comprise compound curves.

* * * * *